United States Patent [19]

Davis

[11] 3,972,048

[45] July 27, 1976

[54] FM-AM WINDSHIELD ANTENNA

[76] Inventor: Ross Alan Davis, 724 Ala Moana Blvd., Honolulu, Hawaii 96813

[22] Filed: Nov. 29, 1974

[21] Appl. No.: 527,954

[52] U.S. Cl. ..... 343/712; 343/742

[51] Int. Cl.[2] ..... H01Q 1/32

[58] Field of Search ..... 343/711, 712, 713, 742

[56] References Cited

UNITED STATES PATENTS

| | | | |
|---|---|---|---|
| 2,923,813 | 2/1960 | Davis | 343/712 |
| 3,007,164 | 10/1961 | Davis | 343/712 |
| 3,210,766 | 10/1965 | Parker | 343/712 |
| 3,728,732 | 4/1973 | Igarashi | 343/713 |
| 3,771,159 | 11/1973 | Kawaguchi | 343/713 |

*Primary Examiner*—Eli Lieberman

*Attorney, Agent, or Firm*—Bruce L. Birchard

[57] ABSTRACT

A conductive body having an opening therein, the edge of opening having a length which is less than a resonant length at AM broadcast band frequencies and greater than a resonant length at FM broadcast band frequencies, is caused to operate as an effective antenna over the FM band or over both the FM and AM bands by electrically shortening the length of the edge of such opening at FM frequencies without physically shortening the perimeter of such opening or electrically shortening the edge of such opening at AM frequencies, a common cable or cables being utilized to couple both AM and FM signals to external circuits, switching at the conductive edge thus being eliminated.

8 Claims, 7 Drawing Figures

FM-AM WINDSHIELD ANTENNA

BACKGROUND OF THE INVENTION

1. Field of the invention

This invention relates to antenna systems and, more specifically, to conductive-body antenna systems which function effectively at both FM frequencies and AM frequencies utilizing a single discontinuity in the conductive body.

2. Prior art

Much of the prior art in this field is attributable to this inventor. Reference may be had to my U.S. Pat. Nos. 2,923,813, 2,971,191 and 3,007,164 for examples of prior art systems. In general, these and other such systems have been directed to operation in a single band of frequencies, usually lower frequencies, for example the AM broadcast band of the United States which covers the spectral region from 540 to 1600 KHz. With the increasing popularity of FM broadcast reception in automobiles, car-body antennas, such as those available prior to this invention, which operate only in the AM broadcast band, are inadequate. The discontinuities, usually windows, relied upon in such systems for the generation of circulating R-F currents which can be extracted and fed to the antenna terminals of associated radio receiving apparatus, have dimensions which are small with respect to a quarter wavelength at AM broadcast band frequencies (540–1600 KHz) and large with respect to FM broadcast band frequencies (88–108 MHz). Methods for forcing resonance of the discontinuity and its surroundings, in the AM band are described in my patent application, Ser. No. 427,258, filed Dec. 21, 1973 and entitled ANTENNA SYSTEM UTILIZING CURRENTS IN CONDUCTIVE BODY. Such a system has proven very effective in the AM band, but operation in the FM band is not aided by such a system. Fundamentally, I was faced with the problem of the normal discontinuity, or window, in a car body being too small to serve my purposes in the AM band and too large to serve my purposes in the FM band.

SUMMARY OF THE INVENTION

By electrically "framing" the oversized discontinuity in a conductive body over the FM band utilizing shunting of such a nature as to exhibit a low impedance at FM frequencies and a high impedance at AM frequencies, and appropriately resonating the remaining conductive body loops, if desired, highly effective performance has been achieved over both the AM broadcast band (540–1600 KHz) and the FM broadcast band (88–108 MHz) with a single discontinuity in a conductive body, for example, a window in a car body, and with a common cable system for coupling both FM and AM signals to associated radio-receiving apparatus.

While the FM and AM broadcast bands have been referred to, this invention may be applied in other situations where reception or transmission, or both, are desired at widely differing operating frequencies utilizing a single discontinuity in a conductive body.

DETAILED DESCRIPTION OF THE ILLUSTRATED EMBODIMENT

Figure 1:
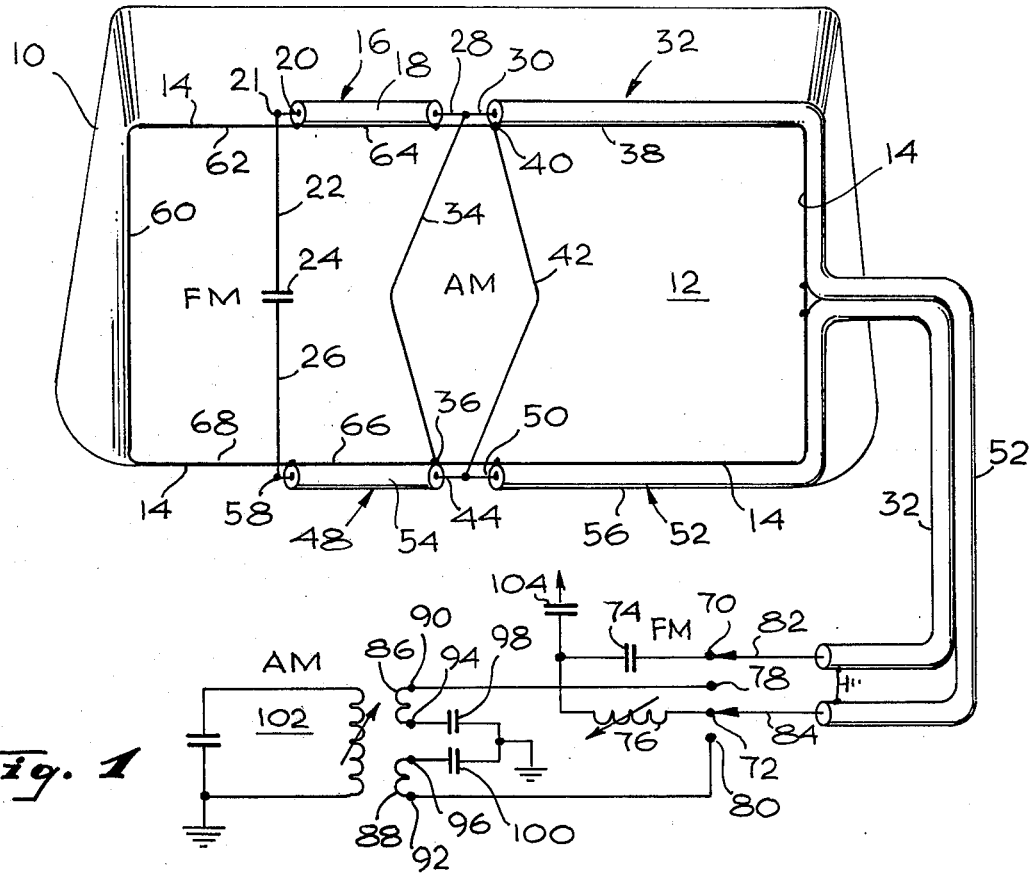
FIG. 1 is a schematic diagram showing an FM-AM antenna system according to the present invention.

In FIG. 1, a conductive body 10 has a discontinuity or opening 12, therein, as a result of which a perimeter or conductive edge 14 is formed. When the conductive body 10 is exposed to an electromagnetic field it responds, particularly to the H vector of that field, to produce a flow of R-F currents in the body 10, which currents tend to circulate through the edge 14 surrounding the opening 12. The length of the edge 14, is, for example, far less than one-quarter wavelength at frequencies in the AM broadcast band (540–1600 KHz) and greater than one-quarter wavelength, and non resonant, over the FM broadcast band (88–108 MHz).

Coaxial cable 16 has its outer conductive sheath 18 electrically connected to the edge 14. Its inner conductor 20, at end 21, is connected to conductor 22, which is coupled through resonating capacitor 24 to conductor 26. Conductors 22 and 26 may be made of thin wire, number 28 gauge, for example. They span opening 12, which may be a window, and, therefore, must obstruct the view therethrough minimally. The capacitance 24 has a very small value, in the order of 9 picofarads and, therefore, once its optimum value has been determined for a particular installation, it may be fixed and formed in production installations by merely overlapping conductors 22 and 26 for a short distance with electrical insulation therebetween.

The remaining end 28 of inner conductor 20 is connected to the inner conductor 30 of coaxial conductor 32, which, in turn, is connected to drive wire 34 which brings driving signals in the AM broadcast band from point 36 on edge 14 to the inner conductor 30. The outer conductive sheath 38 of coaxial cable 32 is connected to edge 14 at point 40, to which drive wire 42 is also connected. Drive wire 42 is connected, at its opposite end, to inner conductor 44 of coaxial cable 48 and to inner conductor 50 of coaxial cable 52 for the purpose of bringing driving signals in the AM broadcast band from point 40 to inner conductor 50 of cable 52. The outer sheaths 54 and 56 of coaxial cables 48 and 52, respectively, are electrically connected to edge 14 at selected points along their lengths. Drive wires 34 and 42 (which are of small diameter, for example number 28 gauge to reduce obstruction of vision) may be spread or separated from each other, as shown, to reduce capacitive loading in the FM broadcast band. The inherent capacitive and inductive coupling between inner conductor 20 of coaxial cable 16 and edge 14 and between inner conductor 44 of coaxial cable 48 and edge 14 is sufficient at frequencies in the FM broadcast band (centered at about 98 MHz) so that conductors 22 and 26 are effectively coupled through reactances to edge 14 at their respective ends connected to points 21 and 58, respectively.

For FM signals in the band from 88 to 108 MHz, therefore, the circuit of FIG. 1 appears to be a loop made up of portions 60, 62, 64, 66 and 68 of edge 14 joined by drive wire 34 and resonated by capacitor 24 in series with the conductors 22 and 26, which have their own inherent inductive reactances at these FM-band frequencies. Condenser 24 splits the single loop, just described, into two loops resonated by this common tuning condenser 24. Dual, out-of-phase FM signals are extracted from the two resonated loops by way of coaxial cables 32 and 52 and such signals are fed to opposite terminals 70 and 72 of a resonant input circuit comprising resonating condenser 74 and slug-tuned inductor 76, when the associated radio receiver has been switched for FM reception, as is indicated in FIG. 1.

In the AM broadcast band, signals appearing across discontinuity 12 are fed, by way of drive wires 34 and 42, through coaxial cables 32 and 52, respectively, to switch contacts 78 and 80, when AM-band operation of the associated radio receiver, not shown, is chosen by moving selector contacts 82 and 84 into cooperation with contacts 78 and 80. In that position, balanced input coils 86 and 88 are fed signals in the AM broadcast band at ends 90 and 92, the opposite ends 94 and 96 being coupled through capacitors 98 and 100, respectively, to ground potential. Capacitors 98 and 100 resonate their associated coils, cables and body-loop antennas. Condenser 98 may be chosen broadly to peak coil 86 and the associated loop formed by the edge 14 of discontinuity 12 at the high-frequency end of the AM-broadcast band, e.g. 1500 KHz, while condenser 100 may be chosen broadly to peak coil 88 and the associated loop formed by the edge 14 of discontinuity 12 at the low-frequency end of the AM-broadcast band, e.g., 540 KHz. Tuned circuit 102 is coupled to the input transistor of the associated radio receiver, not shown. FM signal input to the associated radio receiver, not shown, may be through capacitor 104.

The circuit of FIG. 1 combines FM and AM broadcast band reception, with dual out-of-phase signals being derived for maximum effectiveness of the conductive-body antenna system, while requiring a single pair of coaxial cables.

Figure 2:
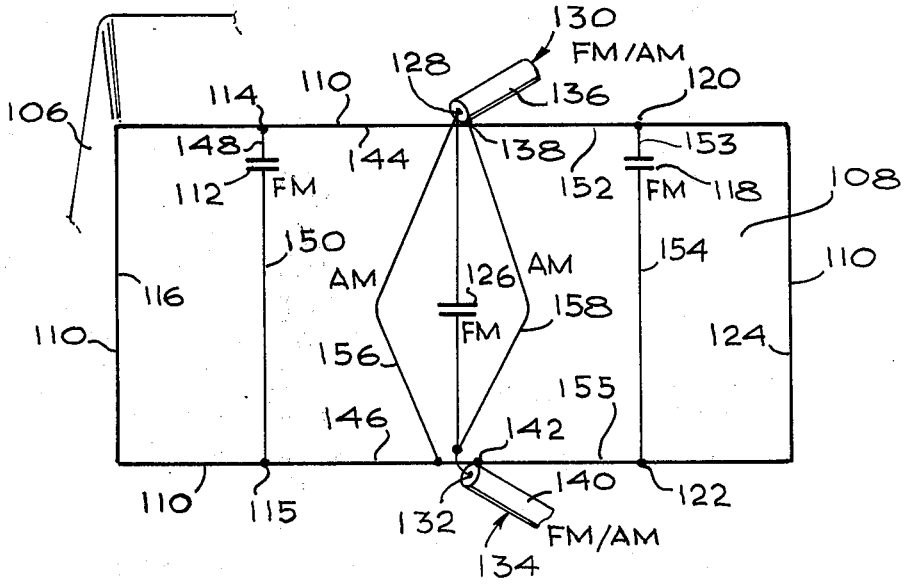
FIG. 2 is a schematic diagram showing a variation of the antenna system of FIG. 1.

In FIG. 2, conductive body 106 has opening 108 therein to form conductive edge 110. The total length of edge 110 is presumed to be large with respect to a resonant fraction of a wavelength at FM broadcast frequencies, i.e., 88 to 108 MHz. To reduce the effective length of edge 110 at FM-band frequencies, by-pass condenser 112 may be shunted between points 114 and 115 on edge 110, such points being removed inwardly from edge portion 116, as shown in FIG. 2. Similarly, by-pass condenser 118 may be shunted between points 120 and 122 on edge 110, such points being removed inwardly from portion 124 of edge 110. The magnitudes of condensers 112 and 118 may approximate 100 pico-farads. For signals at the FM broadcast band frequencies the reactance presented by condensers 112 and 118 is low, while in the AM broadcast band (540–1600 KHz) that reactance is very high. The effect is to reduce the effective opening size in the FM band (that is to "frame" the portion of the edge 110 in the antenna system according to this invention) while at the same time permitting the use of the entire edge 110 in the antenna system, according to this invention for the AM broadcast band.

Tuning condenser 126, which may have a magnitude in the order of 9 pico-farads, is coupled between inner conductor 128 of coaxial cable 130 and inner conductor 132 of coaxial cable 134. Outer conductive sheath 136 of cable 130 is connected to edge 110 at point 138. Outer conductive sheath 140 is electrically connected to edge 110 at point 142. For signals in the FM broadcast band, tuning condenser 126 is effectively coupled between points 138 and 142 on conductive edge 110. In that band it completes and tunes two loops, one including edge portions 144 and 146 (between points 114 and 138, and 116 and 142, respectively) and optional by-pass condenser 112 with its associated connecting wires 148 and 150; and the other including edge portions 152 and 155 (between points 138 and 120, and 142 and 122, respectively) and optional by-pass condenser 118, with its associated coupling wires 153 and 154. The "framing" by by-pass condensers 112 and 118 may not be required if opening 12 is sufficiently small.

For AM broadcast band operation, drive wire 157 picks off conductive-body signals essentially at point 142 on edge 110 and feeds them to center conductor 128 of cable 130. Similarly, drive wire 158 picks off conductive body AM signals essentially at point 138 on edge 110 and feed them to center conductor 132 of cable 134.

The out-of-phase signals in both the AM and FM broadcast bands are fed through respective common coaxial cables 130 and 134 to associated radio receiving apparatus, not shown.

Experiments have shown that optimum performance over the band of frequencies from 88 to 108 MHz may be obtained by offsetting points 138 and 142 from a central location between the points 114 and 120, and 115 and 122, respectively. This phenomenon apparently results from the fact that the two loops thus formed are of slightly different dimensions, one loop favoring the high frequency end of the FM band and the other favoring the low frequency end of that band, the condenser 126 resonating the two loops at two different frequencies in the FM broadcast band and broadening the frequency response of the overall antenna system.

Figure 3:
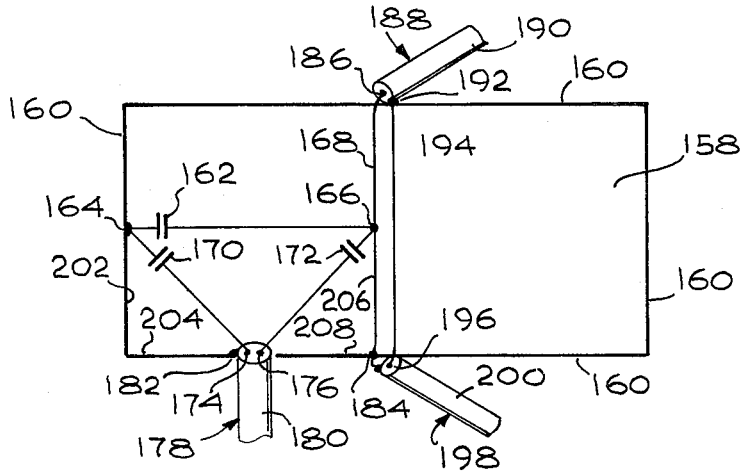
FIG. 3 is a schematic diagram showing an additional embodiment of the antenna system according to my invention.

In FIG. 3, opening 158 in a conductive body, not shown, is surrounded by conductive edge 160. For FM signal purposes it is segmented by by-pass condenser 162 which is of a value (approximately 100 pico-farads, for example) which shunts FM signals between point 164 on edge 160 and point 166 on drive wire 168, point 166 being, for example, centrally located on drive wire 168. Essentially oppositely-phased FM signals are taken from points 164 and 166 and coupled through resonating condensers 170 and 172 to inner conductors 174 and 176 of cable 178, the outer conductive sheath 180 of which is electrically connected to conductive edge 160 at point 182.

Drive wire 168 is connected between point 184 on edge 160 and inner conductor 186 of coaxial cable 188, the outer conductive sheath 190 of which is connected to edge 160 at point 192.

Drive wire 194 picks off AM signals from point 192 on edge 160 and feeds them to inner conductor 196 of coaxial cable 198, the outer sheath 200 of which is electrically connected to edge 160 at point 184.

At FM broadcast band frequencies two loops are formed. One comprises portions 202 and 204 of edge 160 plus the resonating circuit including condenser 170. The other comprises portion 206 of drive wire 168, portion 208 on edge 160 and the circuit including tuning condenser 172. At AM broadcast band frequencies the entire edge 160 and its associated conductive body serves as the antenna.

Figure 4:
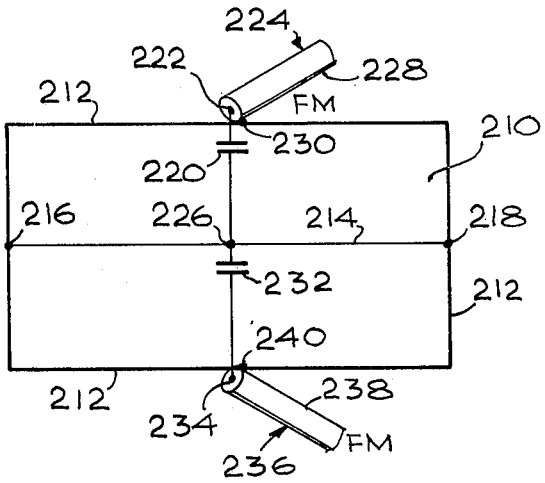
FIG. 4 is a schematic diagram of an FM-only version of an antenna system according to my invention.

In FIG. 4, opening 210 is located in a conductive body, not shown, as a result of which conductive edge 212 is formed. Conductor 214 shunts opening 210 by being connected between points 216 and 218, thereon. Resonating condenser 220 is coupled between center conductor 222 of coaxial cable 224 and point 226 on conductor 214. Outer conductive sheath 228 of cable 224 is electrically connected to edge 212 at point 230.

Resonating condenser 232 is coupled between point 226 and the inner conductor 234 of coaxial cable 236, the outer conductive sheath 238 of which is connected to edge 212 at point 240.

While conductor 214 is shown centrally located in opening 210 it may be displaced off-center to optimize performance of the antenna system over the FM broadcast band. The configuration of FIG. 4 takes the form of two pairs of antennas with two resonating condensers, one common to each pair of antennas. FM output signals are taken through coaxial cables 224 and 236.

Figure 5:
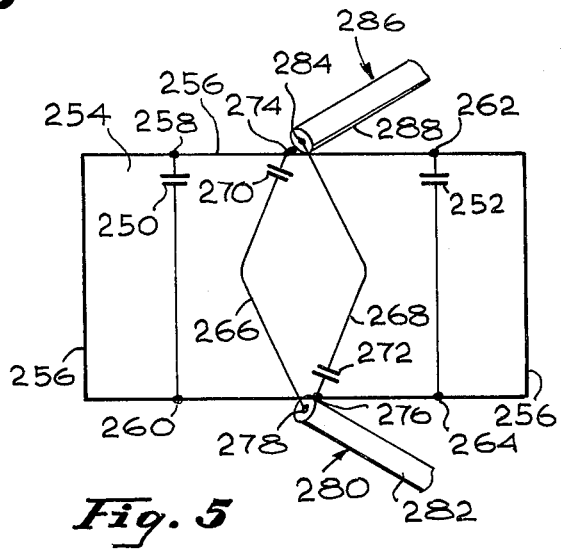
FIG. 5 is a schematic diagram of a variation of the antenna system of FIG. 4, according to my invention.

In FIG. 5, optional condensers 250 and 252 (which may be approximately 100 pico-farads in magnitude of capacitance) "frame" opening 254 in a conductive body, not shown so as to reduce the effective length of the conductive edge 256 at FM band frequencies (and higher), as discussed in connection with FIG. 2. Two loops are formed within the "frame" formed by optional by-pass condensers 250 and 252. One of those loops includes the portions of edge 256 between point 258 and 274, resonating condenser 270, lead 266, the reactive coupling between inner conductor and edge 256, the portion of edge 256 between points 260 and 276 and the shunting circuit including condenser 250. The other loop includes drive wire 268, resonating condenser 272, the portions of edge 256 between points 274 and 288 and 276 and 264, respectively, the inherent coupling between inner conductor 284 and edge 256 and the shunting circuit including condenser 252. Experimental results indicate that optional condensers 250 and 252 may have a capacity of 100 pico-farads while resonating condensers 270 and 272 may have a capacity between 1 and 9 pico-farads.

Cables 280 and 286 may be coupled to series-tuned input circuits at the associated radio-receiver, not shown.

Figure 6:
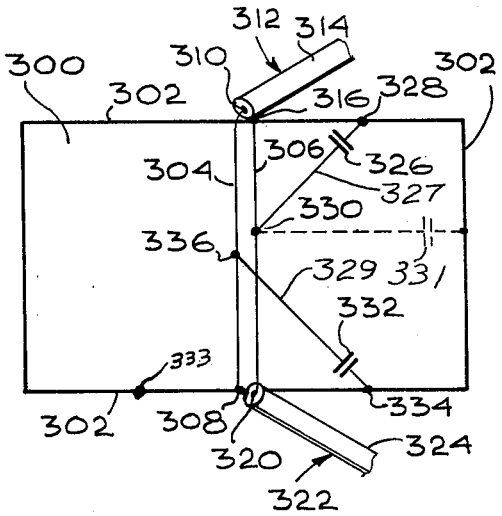
FIG. 6 is a schematic diagram of an additional embodiment of an FM-AM antenna system according to the present invention.

In FIG. 6, opening 300 in a conductive body, not shown, forms a conductive edge 302. For AM-band signal reception, drive wires 304 and 306 are provided. Drive wire 304 is coupled between point 308 on edge 302 and center conductor 310 of coaxial cable 312, the outer conductive sheath 314 of which is connected to edge 302 at point 316.

Drive wire 306 is coupled between point 316 and center conductor 320 of coaxial cable 322, the outer conductive sheath 324 of which is electrically connected to edge 302 at point 308.

For FM signal reception, resonating capacitor 326 is coupled between point 328 on edge 302 and point 330, which may be centrally located on drive wire 306. Resonating capacitor 332 is coupled between point 334 on edge 302 and point 336, which may be centrally located on drive wire 304. While capacitors 326 and 332 are shown as discrete elements, because of the small magnitude of the capacitance required to resonate the conductive-body loops in this frequency range the end portions of conductors 327 and 329, respectively, remote from points 330 and 336, respectively, may be placed proximate to but spaced from edge 302 in the region of points 328 and 334, respectively, to form resonating capacitors in the FM broadcast band range of frequencies. Shunting condenser 331 may be added to reduce the effective loop sizes at FM-band frequencies. Both FM and AM signals pass through cables 312 and 322 to associated receiving apparatus, not shown. The receiver input circuits may correspond to those shown in FIG. 1.

As an alternative configuration for FIG. 6, condenser 332 may be connected between points 330 and 333 and condenser 326 may be connected between points 336 and 328.

Figure 7:
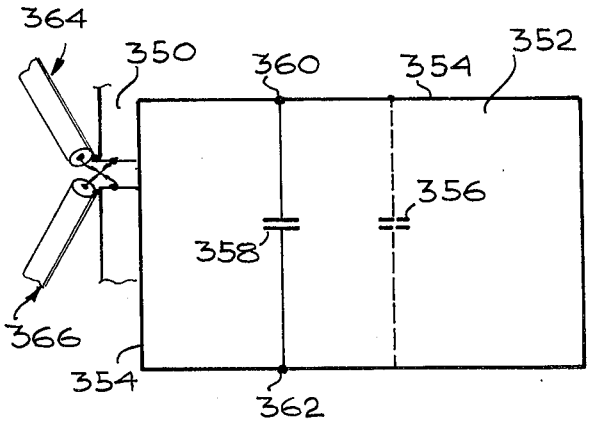
FIG. 7 is a still further embodiment of an FM-AM antenna in the form of a schematic diagram according to the present invention.

In FIG. 7, column 350 contiguous with opening 352 in a conductive body, not shown, has been severed to derive AM signals as described in my patent application Ser. No. 427,258 filed Dec. 21, 1973 and entitled Antenna System Utilizing Currents In Conductive Body. To derive FM signals from the conductive edge 354 surrounding opening 352 optional by-pass condenser or "framing" condenser 356 may be provided, the operation of which has been described in connection with FIG. 2. Resonating condenser 358 resonates the two loops to which it is coupled by connection at points 360 and 362 on edge 354. Output signals in both the AM and FM broadcast bands are taken through cables 364 and 366 by reason of the connection of the center connectors thereof across the column severance, as shown in FIG. 7.

While reference has been made throughout this specification to signal reception, the antenna systems described herein will work equally well in signal transmission.

Further, while reference has been made herein to FM and AM broadcast bands, the antenna systems described herein will work wherever a large frequency difference exists between several bands of frequencies of operation.

While particular embodiments have been described, modifications may be made within the scope of the invention. The following claims are intended to cover such embodiments.

What is claimed is:

1. A vehicle body antenna system, including:

a window opening in said body, said opening having a conductive perimeter and being responsive to radio frequency fields in first and second spectral regions, respectively, to produce, between points along said perimeter, signal potentials corresponding to said fields;

said perimeter having a length greater than a resonant fraction of a wavelength at frequencies in said first spectral region and being small in relation to a resonant fraction of a wavelength in said second spectral region;

framing means including an electrical conductor and a series connected capacitor shunting a portion of the conductive perimeter for reducing, at frequencies in said first spectral region, the effective length of said perimeter;

conductive means medially located across said window for resonating said window in said second spectral region; and, coupling means across said window for coupling to external circuits.

2. Apparatus according to claim 1 in which said external circuits include means cooperating with said conductive means for resonating said window in said second spectral region.

3. Apparatus according to claim 1 in which said coupling means includes first and second coaxial cables each having an external shield and a center conductor, said external shield of said first cable being connected to said perimeter at a first point thereon, said external shield of said second cable being connected to a second point on said perimeter across said window from said first point.

4. Apparatus according to claim 1 in which said coupling means includes first and second coaxial cables each having an external shield and a center conductor;

and said conductive means comprises first and second conductors each spanning said window and having first and second ends;

said external shield of said first cable being connected to a first point on said perimeter and said external shield of said second cable being connected to a second point on said perimeter, said first end of said first conductor being connected to said center conductor of said first coaxial cable and said second end of said first conductor being connected to said second point, said first end of said second conductor being connected to said first point on said perimeter and said second end of said second conductor being connected to said center conductor of said second coaxial cable.

5. Apparatus according to claim 1 which includes, in addition, at least one electrical conductor connected in series with a capacitance and coupled between spaced points along said perimeter for resonating at least a portion of said perimeter in said first spectral region.

6. Apparatus according to claim 1 in which said coupling means is adapted to carry signals in both said first and second spectral regions.

7. Apparatus according to claim 1 in which said window is rectangular in configuration, said perimeter has top and bottom and first and second side portions joined electrically, said coupling means includes first and second coaxial cables each having an external shield and a center conductor, and said conductive means includes first and second electrical conductors each having first and second ends, said external shield of said first cable being connected to a first point on said perimeter, said external shield of said second cable being connected to a second point on said perimeter across said window from said first point, said first end of said first electrical conductor being connected to said center conductor of said first coaxial cable, said second end of said first conductor being connected to said second point, said first end of said second conductor being connected to said center conductor of said second cable and said second end of said second conductor being connected to said first point;

said capacitor in said framing means being connected to a medial point on said first conductor and to a third point on said first side portion;

said second point being located centrally on said bottom to form first and second bottom half-sections;

a fourth point located on said perimeter in said first half-bottom section; and a third cable having an external shield and a pair of inner conductors, one of said pair of inner conductors being coupled through a first resonating condenser to said third point and the other of said pair of inner conductors being coupled through a second resonating condenser to said medial point on said first conductor, said external shield of said third cable being connected to said fourth point.

8. Apparatus according to claim 1 in which said first spectral region is 88 to 108 Mhz and said second spectral region is 540 to 1600 Khz.

* * * * *